US005567139A

United States Patent [19]

Weatherston

[11] Patent Number: 5,567,139

[45] Date of Patent: Oct. 22, 1996

[54] TWO ROTOR SLIDING VANE COMPRESSOR

[76] Inventor: Roger C. Weatherston, 8412 Hidden Oaks, East Amherst, N.Y. 14051

[21] Appl. No.: 492,983

[22] Filed: Jun. 21, 1995

[51] Int. Cl.[6] ..... F04C 18/348

[52] U.S. Cl. ..... 418/173

[58] Field of Search ..... 418/173, 186, 418/256; 417/462, 410.3

[56] References Cited

U.S. PATENT DOCUMENTS

| | | | |
|---|---|---|---|
| 1,654,865 | 1/1928 | Cozette | 418/173 |
| 1,918,408 | 7/1933 | Lakin-Smith | 417/462 |
| 2,537,349 | 1/1951 | Johnson | 418/173 |
| 3,447,513 | 6/1969 | Schneider | 418/173 |
| 3,585,973 | 6/1971 | Klover | 91/67 |
| 3,723,033 | 3/1973 | Tauscher | 418/173 |
| 4,175,393 | 11/1979 | Frank | 418/173 |
| 4,193,748 | 3/1980 | Swain | 418/173 |

FOREIGN PATENT DOCUMENTS

| | | | |
|---|---|---|---|
| 323810 | 9/1934 | Italy | 418/173 |
| 394422 | 6/1933 | United Kingdom | 418/173 |

*Primary Examiner*—Peter Korytnyk
*Attorney, Agent, or Firm*—Howard J. Greenwald

[57] ABSTRACT

A two-rotor, sliding vane rotary compressor for compressing fluid containing an inner rotor, an outer rotor, means for rotating said inner rotor and said outer rotor at the same angular velocity, and at least one sliding vane disposed between the inner rotor and said outer rotor. The outer rotor is has an inner surface which is has at least one flat portion. As the inner rotor rotates, the sliding vane contacts the outer rotor.

2 Claims, 3 Drawing Sheets

TWO ROTOR SLIDING VANE COMPRESSOR

FIELD OF THE INVENTION

A two-rotor, sliding vane compressor in which both rotors rotate at the same angular velocity and in which the sliding vanes have flat heads.

BACKGROUND OF THE INVENTION

Sliding vane compressors are well known to those skilled in the art and are disclosed, e.g., in U.S. Pat. Nos. 5,310,326, 4,384,828, 4,242,065, 4,132,512, 3,877,853, and the like. The disclosure of each of these United States patents is hereby incorporated by reference into this specification.

The classical single rotor-sliding vane compressor is one of the oldest type of compressors on the market. The reason for its early arrival is found in its simplicity of construction and ease of machining. Its disadvantage is that it must operate at low speeds, except for very small machines, requiring large sized compressors, and its efficiency is not sufficiently high to compensate for its size. As a result, except for the very low capabilities, the classical sliding vane compressor has fallen into disfavor with the arrival of improved machining techniques that has fostered other types of compression devices that were not possible to produce in the early days of the sliding vane compressor.

It is an object of this invention to provide a sliding vane compressor which can be operated at a substantially higher speed than prior art sliding vane compressors.

It is another object of this invention to provide a sliding vane compressor which, during its operation, will experience substantially reduced tip loading on the sliding vanes.

It is yet another object of this invention to provide a sliding vane compressor which is substantially more durable than prior art sliding vane compressors.

SUMMARY OF THE INVENTION

In accordance with this invention, there is provided a two-rotor, sliding vane compressor in which both rotors rotate at the same angular velocity and in which the sliding vanes preferably have flat heads.

The rotary sliding vane compressor of this invention incorporates a second outer rotor which is eccentric to, but is completely exterior of, the normal inner rotor. The outer rotor provides the outer sealing surface for the gas volumes that are trapped between the vanes and the inner rotor during the compression process. When the desired pressure level is reached, the gas is expelled through ports in the outer rotor into a discharge passage in a close-fitting housing that surrounds this rotor. The outer rotor turns at the same angular velocity as the inner rotor, and it preferably has a series of flat surfaces on its interior side. Each flat coacts with a vane head that is also preferably flat and greatly extended, resulting in a contact pressure of the vane tips that is markedly reduced over the conventional design. Moreover, since the vane tips and the flats on the outer rotor are both in motion, the relative tip rubbing velocity is very small. As a result of these improved operating conditions, the speed of the subject compressor can be increased well beyond those considered for conventional vane compressors.

BRIEF DESCRIPTION OF THE DRAWINGS

The present invention will be more fully understood by reference to the following detailed description thereof, when read in conjunction with the attached drawings, wherein like reference numerals refer to like elements, and wherein.

DESCRIPTION OF THE PREFERRED EMBODIMENTS

The present invention relates to a two rotor compressor of the sliding vane type so arranged and constructed as to provide an efficient pre compression of the fluid in a working chamber prior to its exposure to a high pressure discharge port. The subject compressor is an improved version of the old line, single rotor-sliding vane compressor. It will be illustrated in this specification by reference to two different embodiments which utilize the same inventive concepts.

The present invention modifies the classical sliding vane compressor in such a way as to improve both its speed characteristics and its efficiency.

A prior art sliding vane compressor

Figure 1:
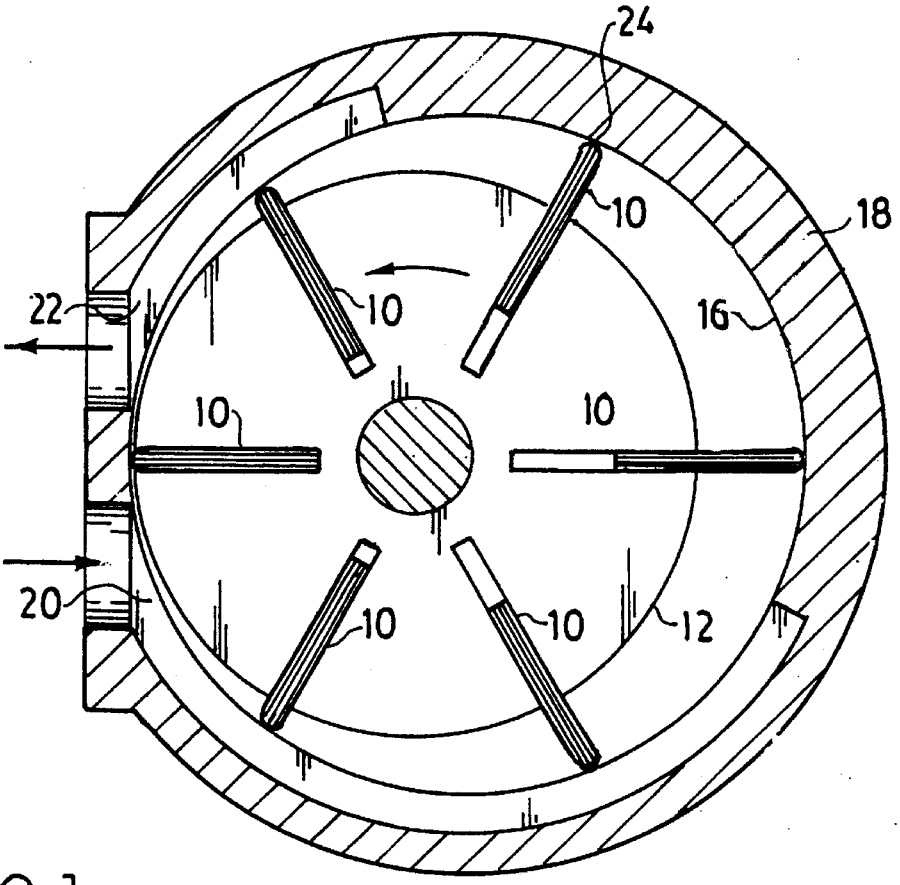
FIG. 1 PRIOR ART
FIG. 1 is a sectional view of the interior of a conventional sliding vane compressor.

For the purposes of illustration, it is beneficial to compare the present two rotor sliding vane design to the classical, single rotor design; the latter design is illustrated in FIG. 1. Such a a comparison will demonstrate the advantages of the two rotor design.

Figure 1A:
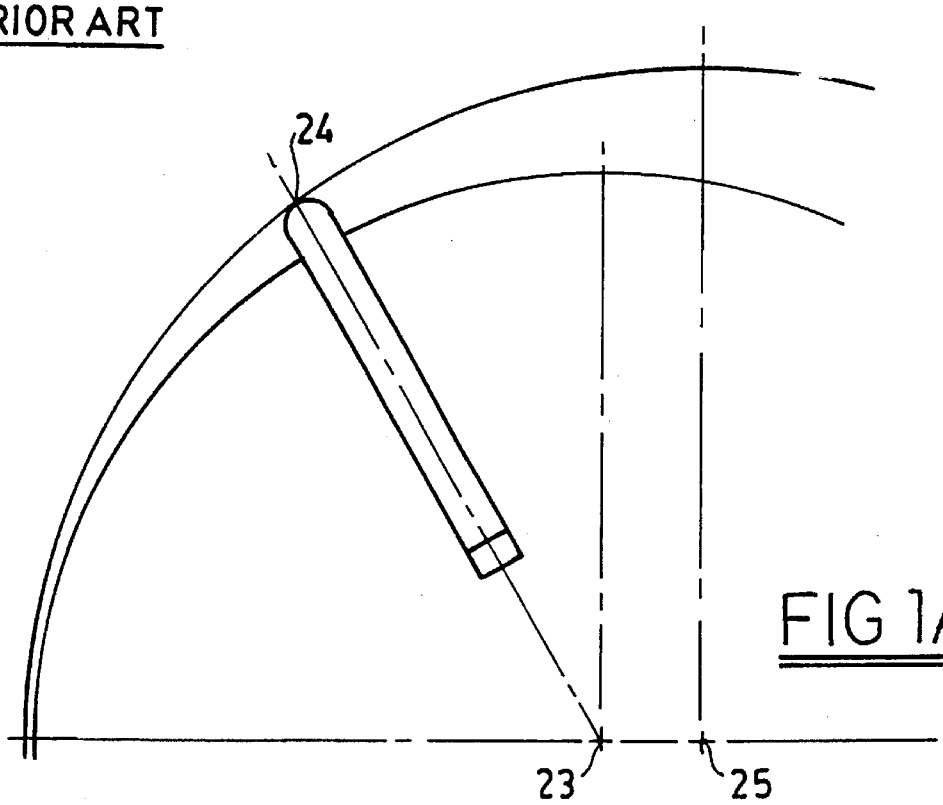
FIG. 1A is an expanded sectional view of the sliding vane compressor of FIG. 1, illustrating the contact between a vane tip and the housing of such compressor.

Referring to FIG. 1, and in the conventional design depicted therein, the sliding vanes 10 are thrown outwardly by centrifugal force as rotor 12 rotates about shaft 14, thereby causing vanes 10 to contact the inner surface 16 of fixed housing 18. Housing 18 is comprised of inlet passage 20 and outlet passage 22. Because the center 23 of rotor 12 and the center 25 of the fixed housing inner surface 16 are eccentric to each other (see FIG. 1A), the tip 24 of the sliding vane 10 does not contact the housing in a normal geometric or flush manner. Theoretically, there is only a line contact of the vanes 10 with the housing inner surface 16, and the contact pressure levels are high because of this non-normal relationship. Moreover, the vane tip 24 wiping velocity is also high, being equal to the tip velocity of the vanes 10 themselves. Because of the high contact pressure and wiping velocities, the classical single rotor compressor depicted in FIGS. 1 and 1A is limited to relatively low speeds except for very small devices, like air tools.

The present invention overcomes these unfavorable features by the incorporation of a second rotor. The construction and operation of the two rotor compressor to achieve these objectives may be understood by reference to FIGS. 2 and 3.

A preferred two rotor compressor of the invention

Figure 2:
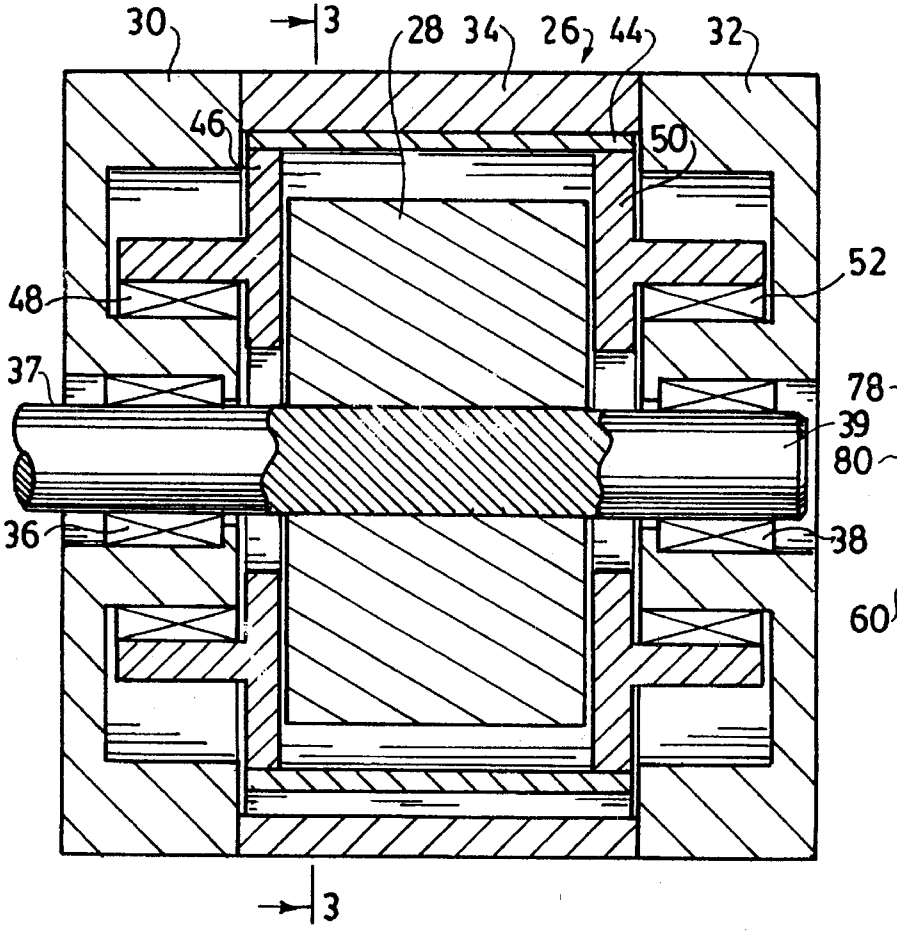
FIG. 2 is sectional view of one preferred embodiment of a two-rotor sliding vane compressor of the invention, illustrating the bearing suspension of the two rotors in the end plates.

FIG. 2 is a cross-sectional view of a compressor 26 taken through the axis of an inner, vane-carrying, rotor 28.

Referring to FIG. 2, it will be seen that the main support structures for the compressor 26 are end plates 30 and 32 and center housing 34. The inner rotor 28 is supported by bearing 36 into end plate 30 and bearing 38 to end plate 32; inner rotor 28 is preferably supported by a support shaft at each of its ends.

Figure 3:
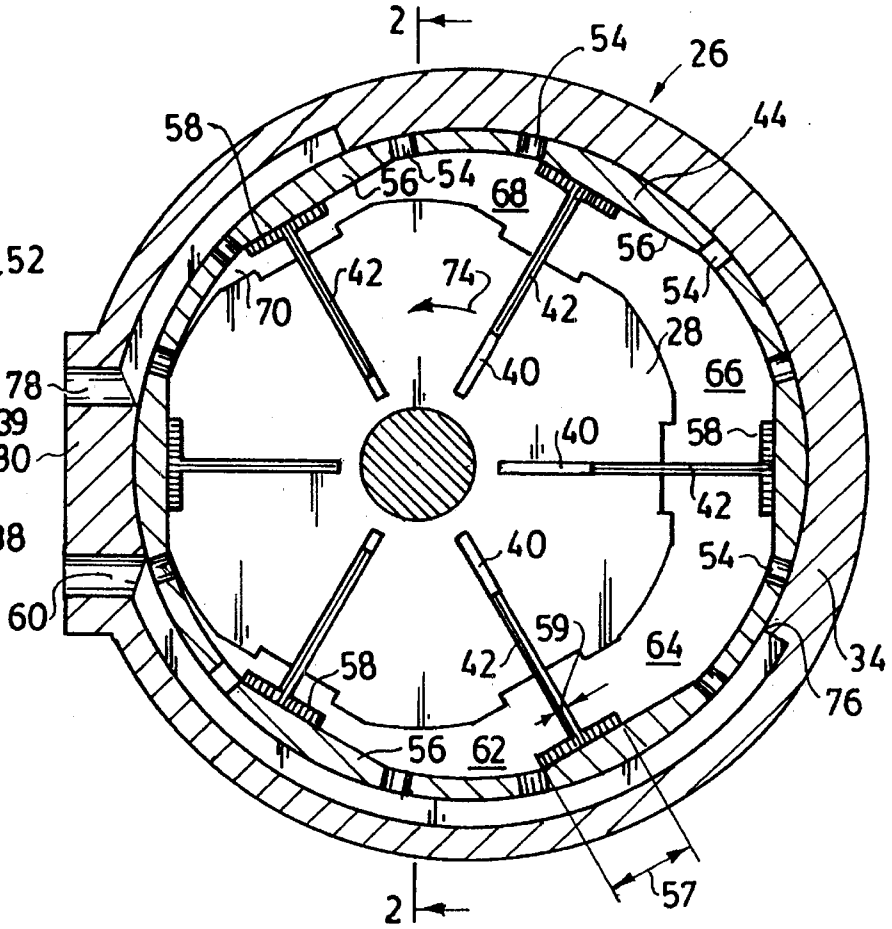
FIG. 3 is a sectional view, taken along lines 3—3 of FIG. 2, of the compressor of FIG. 2, illustrating the structure of the vanes and the inner and outer rotors.

In the embodiment depicted in FIGS. 2 and 3, the inner rotor 28 contains six vane slots, like vane slots 40, and guides six vanes, like vanes 42.

As will be apparent to those skilled in the art, the compressor 26 may contain fewer or more vane slots 40 and vanes 42. Thus, e.g., one may use one sliding vane disposed within the inner rotor 28. Thus, in another embodiment, as few as two vane slots 40 and two vanes 42 may be used; and as many as about 16 such vane slots 40 and vanes 42 may be used. It is preferred, however, to use from about 4 to about 12 such vane slots 40 and vanes 42.

Referring again to FIGS. 2 and 3, the outer rotor 44 is supported by means of side plate member 46 through bearing 48 to end plate 30 and side plate member 50 through bearing 52 to end plate 32. It should be noted that side plate members 46 and 50 are the support members for the outer rotor 44, but they act as side plates for inner rotor 28. Also, it is to be noted that side plates 46 and 50 and the inner rotor 28 have very limited velocity with respect to each other since the side plates and the rotor are both in motion.

Referring again to FIGS. 2 and 3, and in the preferred embodiment depicted, outer rotor 44 has twelve discharge ports 54. In the embodiment depicted, there are two discharge ports 54 for each vane 42. However, as will be apparent to those skilled in the art, more or fewer such discharge ports may be used. It is preferred, however, to use from about 1 to about 2 discharge ports 44 for each vane 42.

In one embodiment, not shown, outer rotor 44 has no discharge ports 54; and the gas flows into and out of outer rotor 44 via side ports (not shown).

Referring again to FIGS. 2 and 3, and in the preferred embodiment depicted, outer rotor 44 has six flat surfaces 56. It may be observed that the heads 58 of the six vanes 48 are preferably flat to match the six flat surfaces 56. Also, it may be observed that the length 57 of flat vane head 58 is much greater than the thickness 59 of the stem of vane 42.

In general, there will be at least one flat surface 56 for each vane 42. It is preferred that there be one flat surface 56 for each vane 42.

Referring again to FIGS. 2 and 3, in operation gas (not shown) is drawn in through the housing entrance passage 60 and fills the working pocket volumes 62, 64, 66, 68, and 70 between the vanes 42, the inner rotor 28, and the outer rotor 44, through ports 54. Both rotors 28 and 44 rotate in the direction indicated by the arrow 74. At some point 76, the housing 34 comes in close contact to outer rotor 44 and the pocket volumes become trapped. As rotation continues, the volume of the pockets is reduced, and the gas becomes compressed. At some point, when the desired pressure level is reached, a port 54 becomes exposed to discharge port 78, and the gas flows out from the working pockets. A small piece 80 of the housing 34 separates the high pressure gas flowing out of port 78 and from inlet port 60.

Figure 5:
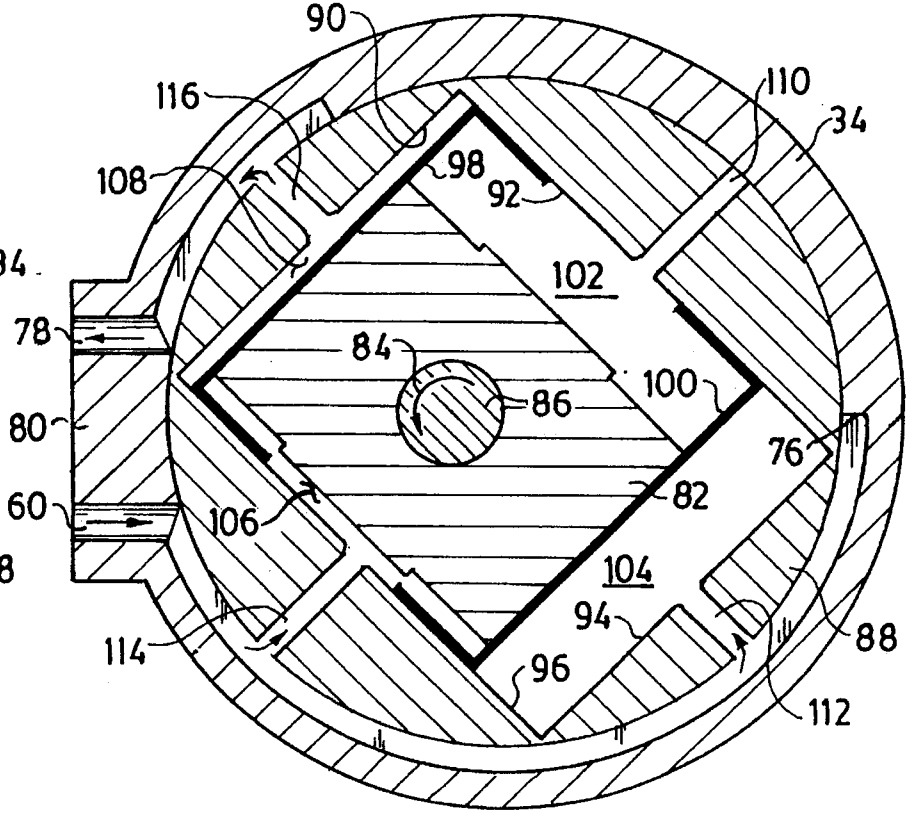
FIGS. 4 and 5 are sectional views of all other preferred embodiment of the two-rotor sliding vane compressor of this invention, illustrating said embodiment in different angular positions, the rotor suspensions depicted in FIGS. 4 and 5 being identical to that depicted in FIG. 2.
Figure 4:
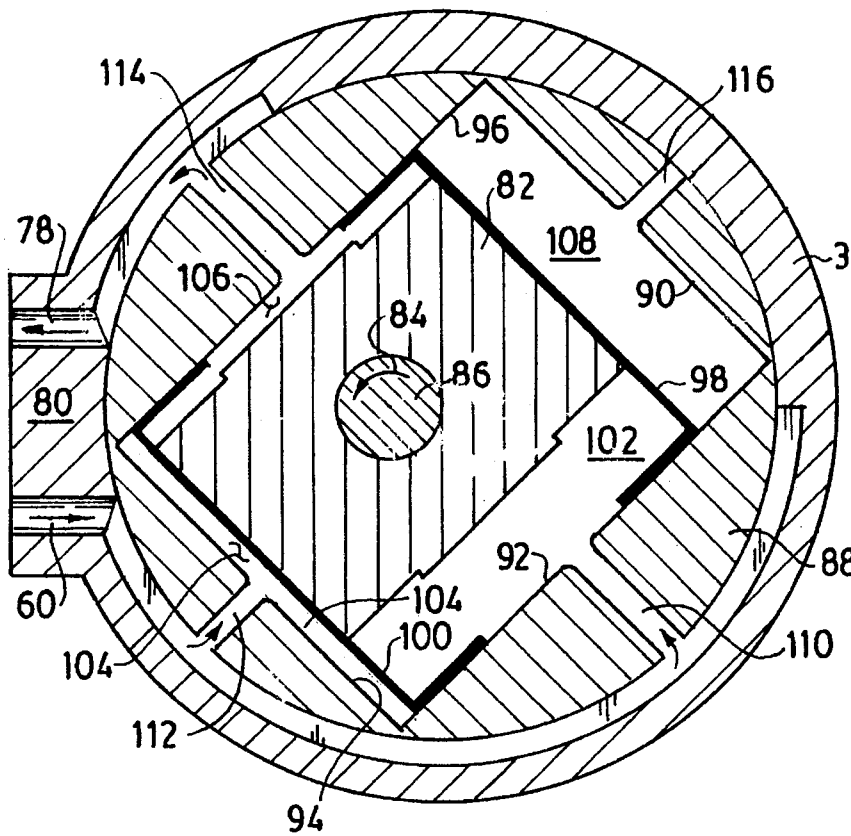

FIGS. 4 and 5 illustrate another embodiment of the invention; in FIG. 5, the inner rotor 82 has rotated 90 degrees in the direction of arrow 84 about shaft 86. As will be apparent to those skilled in the art, the side view of the design of these FIGS. 4 and 5, which illustrates the support means for the inner and outer rotors, and bearing layouts, is exactly the same as FIG. 2 of the first design Although an off-hand observation of the compressor center section of FIGS. 4 and 5 might lead one to conclude that a different compressor is being depicted, it should be apparent that the compressor of FIGS. 4 and 5 utilizes the same inventive concepts as employed in the compressor of FIG. 3. Thus, both compressors utilize a second outer rotor with internal flats that coact flushly with flat vane heads emanating from a first inner rotor, such coaction being made possible by the rotational synchronization of the inner and outer rotors. In reality, the alternative design of FIGS. 4 and 5 is but a limiting case of the general configuration in which the entire inner surface Of the outer rotor consists of rectangularly arranged flats, and wherein the center inner rotor also becomes rectangular, supporting one vane on each of its opposing ends.

Referring to FIGS. 4 and 5, it will be seen that outer rotor 88 surrounds the inner rotor 82 and is eccentric to it, in a manner similar to that of the design of FIG. 3. Inner rotor 82 rotates around shaft 86. The outer rotor 88 is supported by side plates (not shown in FIGS. 4 and 5) like those side plates 46 and 50 of FIG. 2. The outer rotor 88 is comprised of internal flats 90, 92, 94, and 96. Flats 92 and 96 coact with the flat heads of sliding vanes 98 and 100, forcing the two rotors to rotate in synchronization. The four working chambers 102, 104, 106, and 108 coact cyclically with the inlet passage 60 and outlet passage 78, in center housing 34 through ports 110, 112, 114, and 116 in the same manner as depicted in the design of FIG. 3. Block 80 of center body 34 separates the high pressure gas in high pressure outlet 78 form lower pressure gas in inlet passage 60.

Referring again to FIG. 4, working chambers 104 and 102 are ingesting fresh gas from inlet passage 60, chamber 108 is sealed off while the gas is being compressed, and working chamber 106 is delivering gas to discharge port 78. In FIG. 5, by comparison, both rotors are advanced 90 degrees counterclockwise and working chambers 106 and 104 are ingesting gas from inlet passage 60, chamber 102 is undergoing compression, and working chamber 108 is delivering gas to discharge passage 78.

In the construction of the embodiment of FIGS. 4 and 5, there preferably is a structural tie between the ends of sliding vanes 98 and 100 to the ends of slide to hold them snug against the ends of the inner rotor block 82. However, for the sake of simplicity of representation, the depiction of this structural tie has been omitted from FIGS. 4 and 5.

In one embodiment, the device of FIGS. 4 and 5 is utilized as an internal combustion engine.

Features of the claimed compressors

Referring to FIG. 3, the centrifugal outward force of vanes 40 reacts with the outer rotor 34 through flat vane heads 58 acting on the outer rotor flat surfaces 56. This flush contact relationship forces both the inner and outer rotors to rotate at the same angular velocity at all times. The distance vane head 58 oscillates back and forth on rotor flat surface 56 is equal to four times the distance between the centers of rotation of the inner rotor and the outer rotors, for each revolution of the rotors. This distance is equal to about one tenth of the distance that each vane head travels. Hence, comparing the present design to the classical single rotor design, the wiping velocity of the vane tip, for the same size machine, is reduced by about ninety percent. This is a huge advantage. Additionally, the head of the vane 42 can be made to have at least ten times the tip contact area on the flats 56 of the outer rotor 34 as could be attained in a single rotor compressor of the same size. The vanes become "T" or "L" shaped, being much wider at the tip than at the slot position. Hence, the operational advantages of employing the present two rotor design over the classical design are obvious and overwhelming.

It will be apparent to those skilled in the art that the advantages discussed for the embodiment of FIG. 3 are equally present for the embodiment of FIGS. 4 and 5.

There are several other two rotor vane compressors found in the patent literature, but none of these designs feature a synchronization of the angular velocity of the two rotors. This feature makes it possible to employ a flat head on the inside of the outer rotor that will be in constant normal relationship with the head of a vane from the inner rotor. This also allows for a flat vane head which can be extended to reduce the contact pressure. Moreover, since the position of the outer rotor is tied to the position of the vanes, it is possible and practical to add ports to the outer rotor that act as a valving mechanism with respect to the inlet and outlet passage means in the housing that surrounds the rotor. If, as in other designs, the outer rotor is allowed to seek its own speed, depending upon vane tip drag, there is no synchronization between the vanes and the other rotor, and therefore, it cannot act as a timed valving device.

To these skilled in the art obvious changes could be made for particular applications. Crank arms could be employed between the side plate member 46 and inner rotor 28 (see FIG. 2) to force synchronization of the two rotors if the inertial force of the vanes on the outer rotor flats proved to be insufficient to do the job. The number of vanes could be increased or decreased. Skirts could be added to each end of the vanes to reduce the leakage between them and the side plates with which they coact, or through vanes could be employed. It is also possible to relocate the inlet our outlet passage means into the end plates.

As will be apparent to those skilled in the art, the coaction of the flat heads of the sliding vanes on the flat surfaces on the inner surface of the outer rotor, tends to insure that the inner rotor and the outer rotor will have the same angular velocity. However, other additional means, or substitutive means, can be used to insure synchronization of the two rotors.

Thus, by way of illustration, one may utilize rotor cranks for such purpose. Thus, e.g., one may use an Oldham type coupling acting between the inner rotor and the side plates; such Oldham couplings are described, e.g., in U.S. Pat. Nos. 5,383,773 (orbiting rotary compressor having axial and radial compliance), 5,379,516, 5,330,334, 5,320,506, and the like. The entire disclosure of each of these patents is hereby incorporated by reference into this specification.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. A two-rotor, sliding vane rotary compressor for compressing fluid comprising an inner rotor, an outer rotor, means for rotating said inner rotor and said outer rotor at the same angular velocity, and at least one sliding vane disposed between said inner rotor and said outer rotor, wherein:

(a) said outer rotor is comprised of an inner surface, and said inner surface is comprised of at least one flat portion, whereby, as said inner rotor rotates, said sliding vane contacts said outer rotor;

(b) said inner rotor is supported by support shafts on each of its ends;

(c) said compressor is comprised of a first end plate located on a first end of said inner rotor and a second end plate located on a second end of said inner rotor, wherein each of said first end plate and said second end plate supports said inner rotor through a first set of bearings;

(d) said compressor is comprised of a center housing with a circular interior that is eccentric to said inner rotor, said housing being disposed between said first end plate and said second end plate;

(e) said outer rotor has a circular exterior that surrounds said inner rotor but is eccentric thereto;

(f) said outer rotor is mounted on a second set of bearings disposed in said first end plate and said second end plate.

2. A two-rotor, sliding member rotary compressor for compressing gas comprising an inner rotor, an outer rotor, means for rotating said inner rotor and said outer rotor at the same angular velocity, and at least one sliding member disposed between said inner rotor and said outer rotor, wherein:

(a) said inner rotor is comprised of an outer surface, and said outer surface is comprised of at least one flat portion whereby, as said inner rotor rotates, said sliding member slides on said flat surface on said inner rotor and a coacts with said outer rotor;

(b) said inner rotor is supported by support shafts on each of its ends;

(c) said compressor is comprised of a first end plate located on a first end of said inner rotor and a second end plate located on a second end of said inner rotor, wherein each of said first end plate and said second end plate supports said inner rotor through a first set of bearings;

(d) said compressor is comprised of a center housing with a circular interior that is eccentric to said inner rotor, said housing being disposed between said first end plate and said second end plate;

(e) said outer rotor has a circular exterior that surrounds said inner rotor but is eccentric thereto;

(f) said outer rotor is mounted on a second set of bearings disposed in said first end plate and said second end plate.

* * * * *